US010350480B2

(12) United States Patent
Manou

(10) Patent No.: US 10,350,480 B2
(45) Date of Patent: Jul. 16, 2019

(54) BRIDGE AND CUE SUPPORT APPARATUSES TO AID USERS WITH DISABILITIES TO PLAY BILLIARDS AND POOL

(71) Applicant: Nicholas Manou, North Myrtle Beach, SC (US)

(72) Inventor: Nicholas Manou, North Myrtle Beach, SC (US)

( * ) Notice: Subject to any disclaimer, the term of this patent is extended or adjusted under 35 U.S.C. 154(b) by 0 days.

(21) Appl. No.: 15/960,951

(22) Filed: Apr. 24, 2018

(65) Prior Publication Data

US 2018/0304144 A1 Oct. 25, 2018

Related U.S. Application Data

(60) Provisional application No. 62/488,920, filed on Apr. 24, 2017.

(51) Int. Cl.
*A63D 15/10* (2006.01)

(52) U.S. Cl.
CPC ..... *A63D 15/105* (2013.01)

(58) Field of Classification Search
CPC ..... A63D 15/00; A63D 15/10
See application file for complete search history.

(56) References Cited

U.S. PATENT DOCUMENTS

| | | | | | |
|---|---|---|---|---|---|
| 570,459 | A * | 11/1896 | Cronin | A63D 15/105 | 473/43 |
| 953,167 | A * | 3/1910 | Furey | A63D 15/105 | 473/43 |
| 1,149,834 | A * | 8/1915 | James | A63D 15/105 | 2/16 |
| 3,563,543 | A * | 2/1971 | Hamilton | A63D 15/105 | 473/43 |
| 4,210,325 | A * | 7/1980 | McCann | A63D 15/105 | 473/43 |
| 4,953,860 | A * | 9/1990 | Ames | A63D 15/105 | 473/42 |
| 9,067,126 | B2 * | 6/2015 | Lucero | A63D 15/105 | |
| 9,486,696 | B2 * | 11/2016 | Buckhault | A63D 15/105 | |
| 2006/0009300 | A1 * | 1/2006 | Hernandez | A63D 15/105 | 473/42 |

* cited by examiner

*Primary Examiner* — Eugene L Kim
*Assistant Examiner* — Christopher A Glenn

(57) ABSTRACT

Provided are bridge support apparatuses and cue stick supporting apparatuses to aid a person with a disabled hand or hands, or to aid a person with a missing hand or two missing hands, to allow a person to effectively play games that require a cue stick or another game related stick that requires supporting, aiming and carrying, including the games of billiards and pool. The cue stick supporting apparatuses are adjustable to grip onto and hold a cue stick to be used and to be carried.

18 Claims, 10 Drawing Sheets

105
103a
103
B-B
113
107
1"
109
103b
107
113
1.5"

100
101
101c
101a
101b

BRIDGE AND CUE SUPPORT APPARATUSES TO AID USERS WITH DISABILITIES TO PLAY BILLIARDS AND POOL

REFERENCE TO RELATED APPLICATIONS

This application claims one or more inventions which were disclosed in Provisional Application No. 62/488,920, filed Apr. 24, 2017, entitled "Billiards Systems." The benefit under 35 USC § 119(e) of the United States provisional application is hereby claimed, and the aforementioned application is hereby incorporated herein by reference.

BACKGROUND OF THE INVENTION

Field of the Invention

The present inventive concept pertains to the field of billiards and pool games. More particularly, the present inventive concept pertains to bridge supporting apparatuses and cue stick supporting apparatuses to aid players with disabilities to effectively play games such as billiards and pool.

Description of Related Art

"Billiards" and "pool" are terms used to refer to cue sports, i.e., games played by manipulating a cue to strike one or more balls and drive the balls across a table. Some such games include, for example, three-cushion billiards, in which a ball is struck to bounce off walls of the table no more than three times while striking other balls on the table. Pool is a game in which the table may have pockets and a cue ball is driven into other balls with the cue to attempt to knock the balls into the pockets. Many different such cue sports exist, all of which hinge on a user's ability to manipulate a cue.

A typical cue used in cue sports is a straight shaft with a wide end tapering down over the length of the shaft to a tapered end which is used to strike the balls. Traditionally, cue sports require each player to have two functioning hands to manipulate the cue. In practice, the wide end of a cue is grasped with one hand and a user supports a tapered end of the cue with their other hand. By forming their fingers and hand into a "bridge" shape to support the tapered end, a user may aim the tapered end of the cue to strike balls during cue sports.

As a result, prospective cue sports players who lack two functioning hands are at a distinct disadvantage to more able-bodied players. If these players lack a functioning hand, they will have a difficult time moving and aiming the cue effectively. As a result, such impaired players cannot compete effectively against more able-bodied players.

Bridges attached to sticks have been used in the games of billiards and pool for several decades. These bridges are generally placed on a game table while the stick is held in a user's first hand. The user's other hand will hold a cue stick used to hit a billiard ball or pool ball. An end of the cue stick having the tip used to contact the ball is generally placed in one of several notches of the bridge or when the ball is far from the user and therefore hard to reach with the cue stick alone. And even if the user can reach the ball with the tip of the cue stick from a far distance, sometimes the angle required to successfully hit the ball so that the ball traverses in the desired direction is hard to obtain. Thus the user can hold the cue stick with one hand while placing the end of the cue stick with the tip in one of the notches of the bridge at a desired angle so that the ball can be hit successfully.

However, user's with one or both disabled hands, or a user with one or both hands missing, can not hold either the cue stick or the bridge, and therefore are prevented from enjoying the games of billiards and pool.

Accordingly, there is a need to provide a user having one or two disabled hands with the ability to hold a cue stick to play billiards or pool. There is also a need to provide a user having one or two disabled hands with the ability to hold a bridge to play billiards or pool. There is a need to provide a user having one or no hands with the ability to hold a cue stick to play billiards or pool. There is also a need to provide a user having one or no hands with the ability to hold a bridge to play billiards or pool.

SUMMARY OF THE INVENTION

The foregoing and other features and utilities of the present inventive concept can be achieved by providing an arm bridge apparatus, including: a bridge plate including: at least one notch at a top side, at least one cue hole therein to receive a cue stick, a curved bottom side, and at least two holes in a middle portion thereof adjacent to a center of the curved bottom side; an arm support including: a first portion extending lengthwise having at least two slits aligned with and adjacent to a first side of the first portion, and a second portion extending at a predetermined angle away from one end of the first portion, the second portion being shorter than the first portion and connected to the bridge plate at the at least two holes therein; and at least two straps connected at a first end to a second side of first portion of the arm support, each strap extending across a bottom of the arm support and extending into a respective one of the slits along the first side of the first portion of the arm support, the at least two straps including a fastener to fasten the straps around a user's forearm.

In an example embodiment, the bridge plate includes a plurality of notches on each side of the top side thereof.

In another example embodiment, the bridge plate includes a cue hold equally disposed at opposite sides thereof.

In another example embodiment, the at least two straps are formed of nylon or leather.

In still anther example embedment, the bridge plate and the second portion of the arm support are connected by rivets.

In still anther example embedment, the fasteners are a pair of hook and loop fastener pads.

In yet another example embodiment, the first portion of the arm support further comprises a loop fastened to the second side thereof adjacent to the first end of each strap, each loop having a length to receive a second end of each respective strap after the strap is wrapped around the person's forearm such that the hook fastener pad extends through the respective loop and folds over to attach to the loop fastener pad.

In yet another example embodiment, the hook fastener pad and the loop fastener pad are positioned on opposite sides of the respective strap such that when the strap is wrapped around the person's forearm, the hook fastener pad attaches to the loop fastener pad.

In yet another example embodiment, the bridge plate is formed of wood.

The foregoing and other features and utilities of the present inventive concept can also be achieved by providing a hand bridge apparatus, including: a bridge plate including: at least one notch at a top side, at least one cue hole therein to receive a cue stick, a curved bottom side with a eyelet extending through each end of the curved bottom side, and at least two holes in a middle portion thereof adjacent to a center of the curved bottom side; a strap with a first end connected to a first one of the eyelets, including: a first connecting member, and at least one second connecting member positioned such that the first connecting member can fold over and attach to the at least one second connecting member; and a loop extending through the second eyelet to receive the second end of the strap and the first connecting member such that the first connecting member can fold over and connect to the at least one second connecting member.

In an example embodiment, the first connecting member is a hook fastener pad and the at least one second connecting member is a loop fastener pad.

In another example embodiment, the first connecting member is a slit through the strap and the at least one second connecting member is at least one button.

In another example embodiment, the first end of the strap is connected to the first eyelet via a rivet.

The foregoing and other features and utilities of the present inventive concept can also be achieved by providing a cue ring apparatus to support a cue therein, comprising; a strap including a hook fastener pad attached at a first end thereof and on a first side and a loop fastener pad attached at a second end thereof on a second side; an adjustable cue ring connected at a center of the strap such that the cue ring extends perpendicular to the strap.

In an example embodiment, the cue ring is connected to the strap by sewing the cue ring to the strap.

In another example embodiment, the adjustable cue ring includes tracks extending circumferentially around the ring and a screw connected at a side thereof such that threads of the screw engage with the tracks to adjust a diameter of the ring when the screw is rotated.

The foregoing and other features and utilities of the present inventive concept can also be achieved by providing an arm cue sling apparatus, comprising: a strap including a hook fastener pad attached at a first end thereof and on a first side thereof, and a loop fastener pad attached at a second end thereof and on a second side thereof; an adjustable cue ring connected at a center of the strap such that the cue ring extends directly parallel with the strap.

In an example embodiment, the cue ring is connected to the strap by sewing the cue ring to the strap.

In another example embodiment, the adjustable cue ring includes tracks extending circumferentially around the ring and a screw connected at a side thereof such that threads of the screw engage with the tracks to adjust a diameter of the cue ring when the screw is rotated.

In still another example embodiment, the strap is approximately 10.25 inches in length to extend around and fasten to a person's arm.

DETAILED DESCRIPTION OF THE INVENTION

A billiards system according to exemplary embodiments of the present general inventive concept comprises a hand bridge and a cue holder. These apparatuses allow an individual to participate in the game of billiards if their hands are impaired or even missing.

As noted above, a typical pool or billiards cue (a tapered game stick with a leather tip to strike a game ball) has a wide end for holding with a hand and a narrow end which is used to strike a billiard ball. The cue tapers down from the wide end to the narrow end referred to as a tip. The tip is disposed at the narrow end and is usually made of leather so that the tip can grip the pool or billiards ball rather than slide off the ball when the tip of the cue makes contact with the ball. The billiards system allows a user to manipulate the narrow end by moving the wide end with one hand to play billiards/pool effectively.

Figure 1:
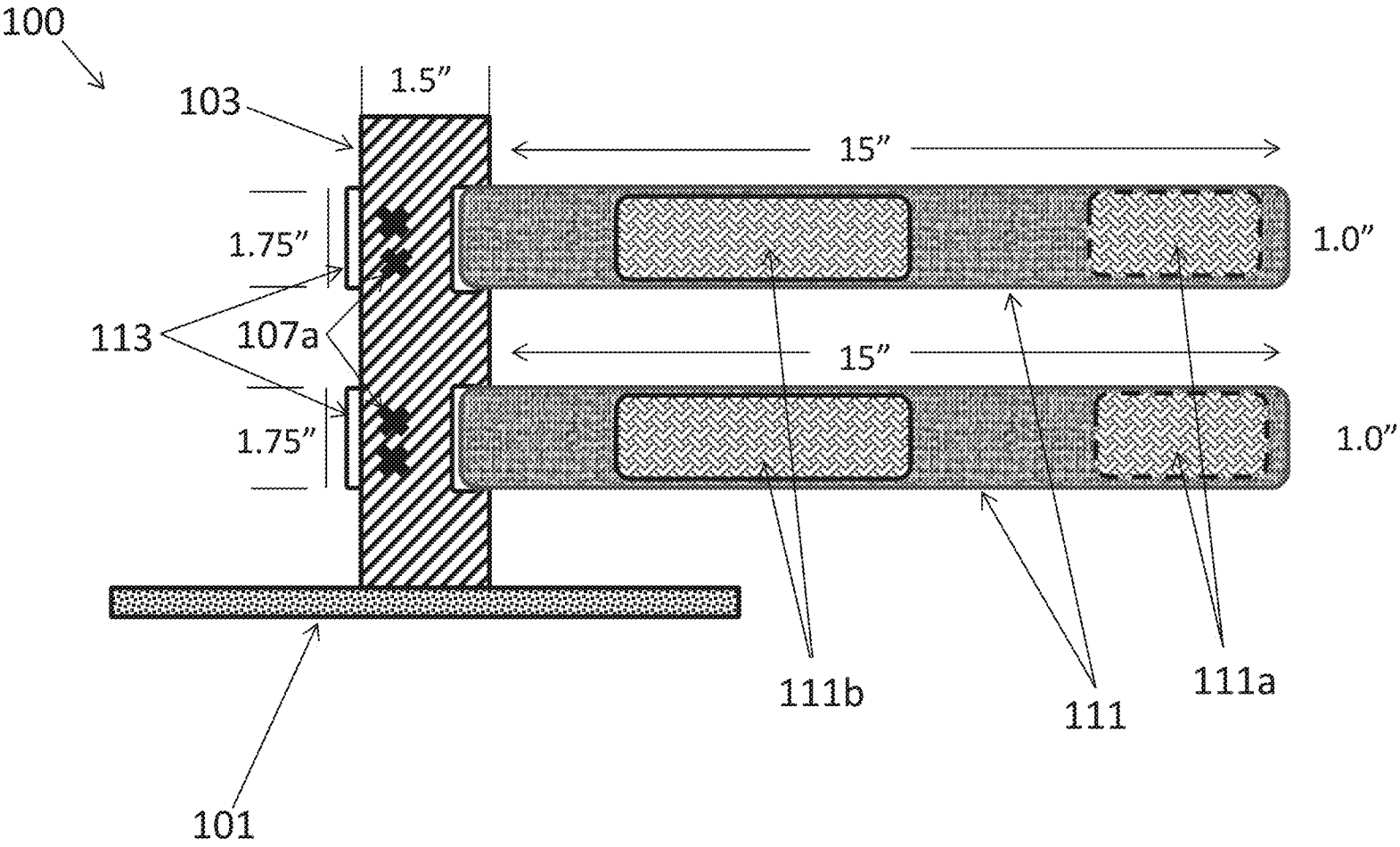
FIG. 1 illustrates a top view of an arm bridge apparatus according to an example embodiment of the present inventive concept.

FIG. 1 illustrates an arm bridge apparatus 100 according to an exemplary embodiment of the present inventive concept. The arm bridge apparatus 100 may be used to support the cue to facilitate aiming the cue at a ball. The arm bridge apparatus 100 may include a bridge plate 101 and an arm support 103. The bridge plate 101 can be a single piece of wood including one or more notches 105 on a top side thereof to receive and support a cue. Alternatively, the bridge plate 101 can be formed of any material, such as, for example fiberglass, plastic, etc., that will allow the cue to slide along sides thereof while supporting the cue. The arm support 103 can include at least two straps 111, each strap including a first connector and a second connector, the first connector and second connector are formed to connect to each other.

Hook and loop fasteners are commonly sold under the trademark Velcro® and may be used in the present invention. The first connector may be a hook fastener pad 111*a* and the second connector may be a loop fastener pad 111*b*. The hook fastener pad 111*a* and the loop fastener pad 111*b* are formed to be spaced apart from each other along the strap 111. The straps 111 wrap across a user's forearm such that the arm support 103 extends lengthwise along the opposite side of the user's forearm and the bridge plate 101 is positioned closest to a user's wrist.

The arm support 103 can be formed of a metal that is strong to support the bridge plate. Alternatively, the arm support 103 can be formed of any material, such as, for example fiberglass, plastic, etc., that will support the bridge plate 101 securely while resting at a comfortable position along the user's forearm.

The straps 111 can be made from a nylon material or leather material. However, the straps 111 can alternatively be formed of any material that will perform the intended purposes as described herein.

According to an exemplary embodiment, the bridge plate 101 may have several notches 105 to allow for multiple angles and positions of a cue to be supported by the bridge plate 101. The bridge plate 101 can be secured to the arm support 103 with a pair of rivets 107*a* that extend through holes 101*a* in the bridge plate 101 and respective holes 105 of in arm support 103, which is explained in more detail with respect to FIGS. 2-5.

Figures 2, 3:
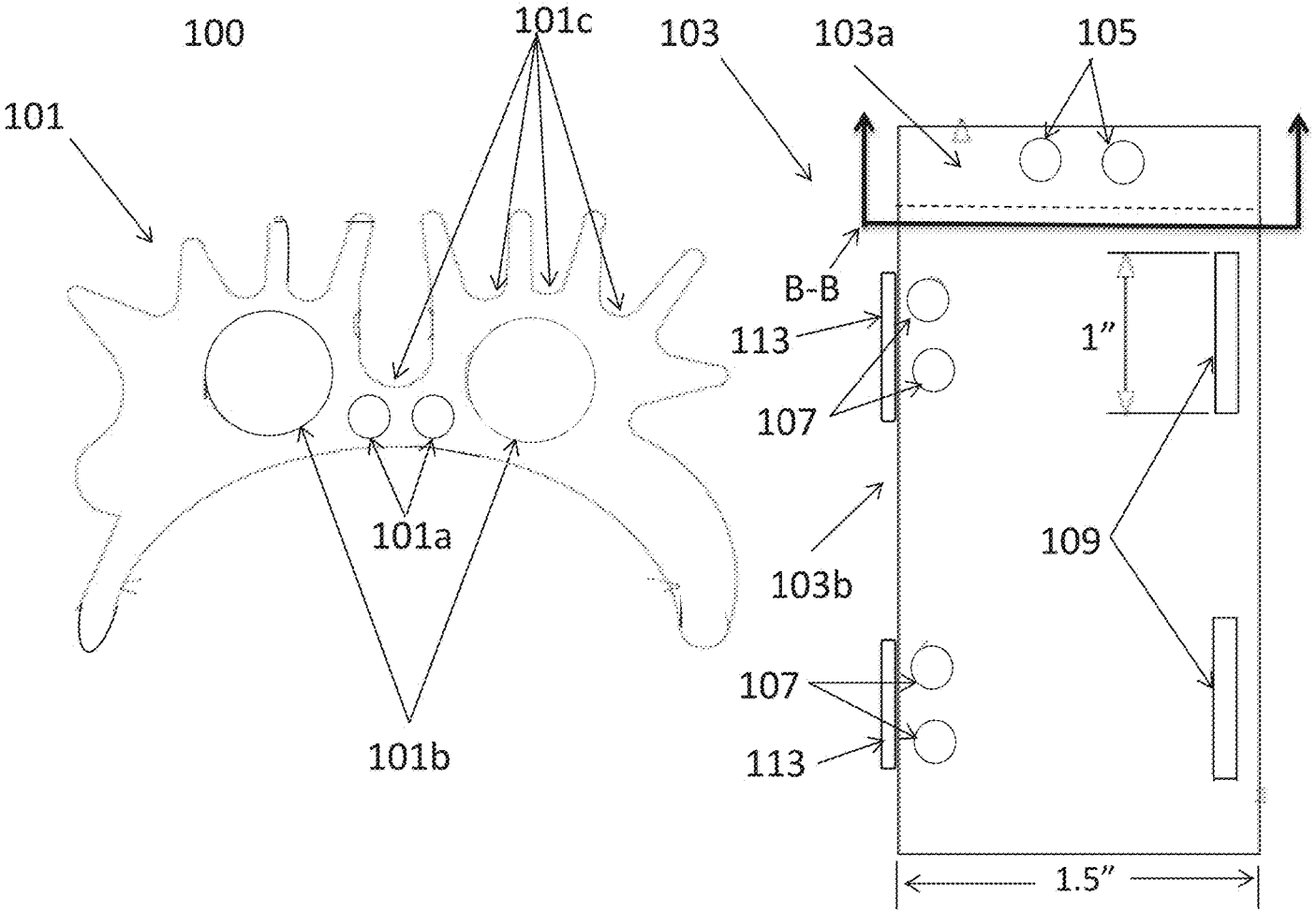
FIG. 2 illustrates a bridge part of the arm bridge apparatus according to the example embodiment of FIG. 1.
FIG. 3 shows illustrates a top view of an arm support part of the example embodiment of FIG. 1.

FIG. 2 illustrates the bridge plate 101 according to the embodiment of FIG. 1. As illustrated, the bridge plate 101 can include a plurality of notches 101*c* formed along a top portion thereof. Each notch 101*c* is formed to hold a cue therein to aid a user in holding and aiming the cue toward a billiard/pool ball. The notches 101*c* are located along the top of the bridge plate 101 to allow a user to point the cue in a supported manner at different angles toward the ball. A pair of cue holes 101*b* is also formed in the bridge plate 101 to receive the cue therein and to provide more options for supporting and angling the cue.

FIG. 3 illustrates a top view of the arm support 103 according to the embodiment of FIG. 1, before a first section 103*a* thereof is bent to a predetermined angle with respect to a second section 103*b*. The first section 103*a* is bent with respect to the second section 103*b* so that while the second section 103*b* rests along a user's forearm the first section 103*a* is connected to the bridge 101. In exemplary embodiment, the bend between the first section 103*a* and the second section 103*b* can provide for the first section 103*a* to extend upward away from the user's arm by a predetermined angle to effectively support a cue to hit a billiard ball or pool ball resting on a billiards table. The first section 103*a* can be angled at approximately 90 degrees with respect to the second section 103*b*. The width of the arm support 103 is approximately 1.5 inches so as to securely rest up a user's forearm while not extending past the user's forearm.

Once the first section 103*a* is bent with respect to the second section 103*b*, the pair of holes 105 in the second section 103*b* is aligned with the pair of holes 101*a* in the bridge plate 101. A rivet 107*a* extends through each pair of the holes 101*a* and 105, respectively, to permanently fasten the bridge plate 101 to the arm support 103. As described above with respect to FIG. 1, one end of each strap 111 is riveted to the corresponding pair of holes 107 at an underside of the second section 103*b* of arm support 103 (see FIG. 1). Then the straps 111 extend across the underside of the second section 103*b* of the arm support 103 and are inserted through a respective slit 109 to extend out of a top side of the second section 103*b*. At this point a user can slide his/her arm between the straps 111 and the bottom of second section 103*b* of the arm support 103. The straps 111 can then be brought around the user's arm over the portion of the straps 111 which the user's forearm extends through, and back over the top of the second portion 103*b* of the arm support 103 so that the hook fastener pad 111*a* on one side of each strap 111 can adhere to the loop fastener pad 111*b* on the opposite side of each strap 111 (see FIG. 1) to securely fasten the arm bridge apparatus 100 onto the upper side of a user's forearm.

In an alternative embodiment, a pair of loops 113 can be fastened to a side of the second portion of the arm support 103 opposite the side in which the slits 109 are formed, each loop 113 being fastened adjacent to respective pairs of holes 107. In this example embodiment, each strap 111 can be fed through a respective loop 113 and then folded back over to attach the hook fastener pad 111*a* to the loop fastener pad 111*b*. Here the Velcro® pads are positioned on the strap 111 such that the hook fastener pad 111*a* extends through the loop 113 while the loop fastener pad 111*b* stops short of the loop 113, thus providing for the hook fastener pad 111*a* to fold over and attach to the loop fastener pad 111*b*. In this case the hook fastener pad 111*a* and the loop fastener pad 111*b* would be positioned on the same side of the strap 111.

Figure 4:
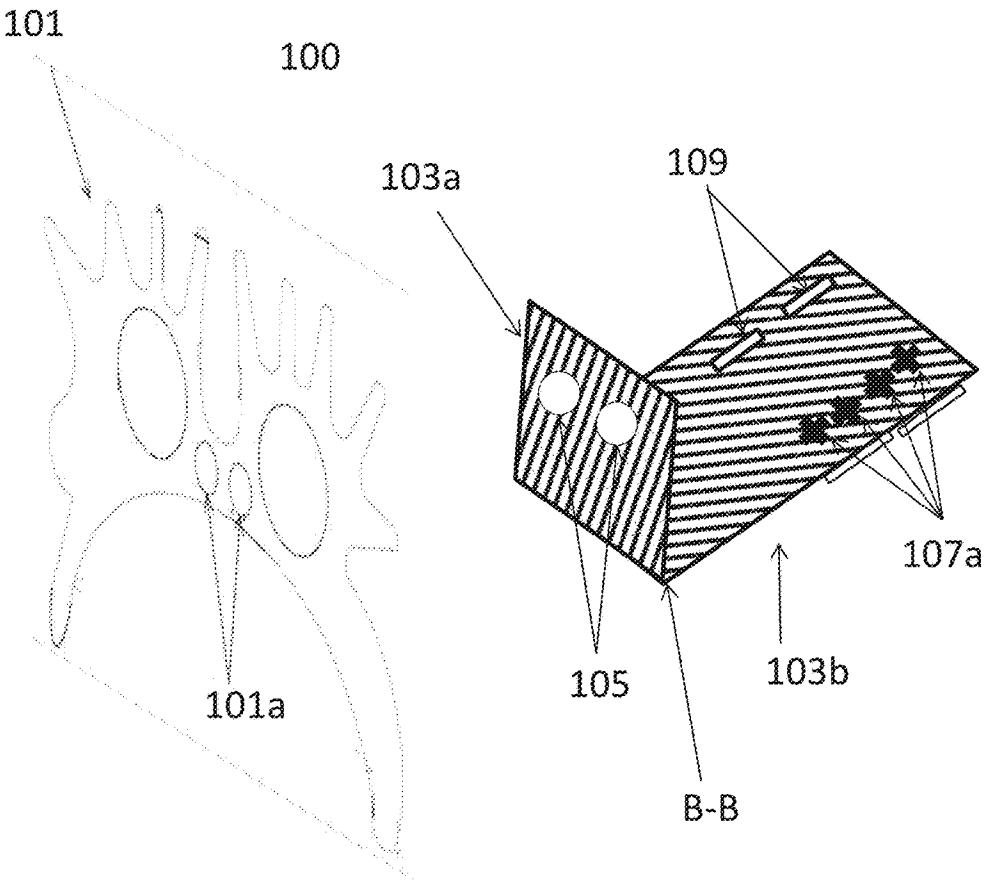
FIG. 4 illustrates a plan view of the bridge part and the arm support part of the arm bridge apparatus according to FIG. 1 prior to assembly.

FIG. 4 illustrates how the bridge plate 101 is aligned with the arm support 103 so that a rivet 107*a* can extend through each aligned pair of holes 101*a* and 105 to secure the bridge plate 101 to the arm support 103. Alternatively, the bridge plate 101 and the arm support 103 can be attached to each other via screws, welding, etc.

Also illustrated in FIG. 4 are two pairs of rivets 107*a* at one side of the second section 103*b* of the arm support 103, each pair of rivets 107*a* corresponding to a respective slit 109 at the opposite side thereof and connecting one end of a corresponding strap 111 to a respective pair of holes 107 (see FIG. 3). As described above, the straps 111 are secured to the holes 107 underneath the second portion 103*b* of the arm support 103, as illustrated in FIG. 1.

Figure 5:
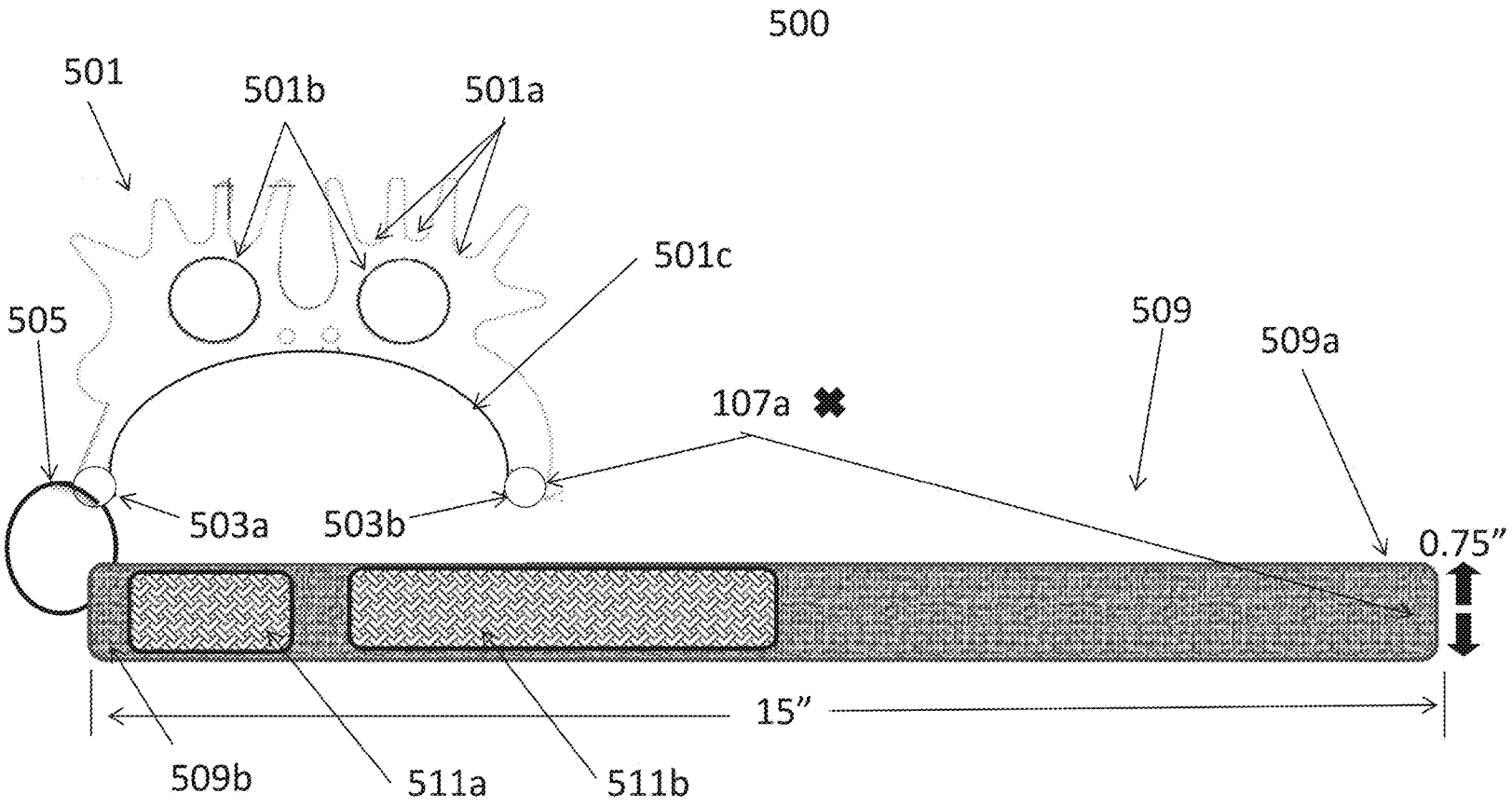
FIG. 5 illustrates main parts of a hand bridge apparatus according to another example embodiment of the present inventive concept, prior to assembly.

FIG. 5 illustrates a hand bridge apparatus 500 according to another example embodiment of the present inventive concept. As illustrated in FIG. 5, a strap 509 can be formed to a length of approximately 15 inches in order to provide sufficient length to wrap around most hands of a user, about the palm area, and to provide enough length for the strap 509 to fold over itself and stick together with the aid of a hook fastener pad 511*a* and a loop fastener pad 511*b*, respectively, as described in more detail below. The length of the strap 509 can alternatively be custom made to fit any user's hand. The width of the strap 509 is approximately 0.75 inches. Also provided is a bridge plate 501 to support a cue. The width of the strap 509 can alternatively be formed to any custom width that will provide the bridge plate 501 with a sufficient support, once attached to the strap 509, such that the bridge plate 501 will remain standing upright with respect to the strap 509 when the strap 509 is fastened to the user's hand.

The bridge plate 501 is similar to the bridge plate 101 according to the embodiment of FIG. 1, accept that the bridge plate 501 can also include eyelets 503*a* and 503*b* disposed at two respective bottom opposing ends thereof. The bridge plate 501 includes a plurality of notches 501*a* and two holes 501*b* in which to place a cue to support and help angle a cue when playing billiards or pool. The bridge plate 501 also includes an arched bottom part 501*c* which a user can place on a top part of his/her hand before fastening the bridge apparatus 500 to the hand by tightening and attaching the strap 509 to the hand as described in more detail below.

A loop 505 is place through eyelet 503*a* of the bridge plate 501 to receive an end 509*b* of the strap 509. An opposite end 509*a* of the strap 509 is riveted through the other eyelet 503*b* of the bridge plate 501 with a rivet 107*a*. The strap 509 is preferably riveted at a center part of the first end 509*a* to provide the least amount of twist and the most secure connection between the bridge plate 501 and the strap 509 when a user fastens the strap 509 to the user's hand. The strap 509 includes a hook fastener pad 511*a* positioned near the end 509*b* thereof so that it can stick to a loop fastener pad 511*b* positioned adjacent to the hook fastener pad 511*a* when the hook fastener pad 511*a* is inserted through the loop 505 and then folded back over the loop 505 and aligned over the loop fastener pad 511*b*. Alternatively, the strap 509 can include other forms of attaching to itself after being inserted through the loop 505, such as for example a series of buttons and a slit such that the slit extends through the loop 505 and then can be fastened to any desired button that was enable to hand bridge apparatus 500 to fit snuggly on a user's hand.

When using Velcro®, the loop fastener pad 511*b* is generally longer than the hook fastener pad 511*a* to provide for adjustment of tightness for different size hands. In other words, if a user's hand is small, the hook fastener 511*a* pad will tend to extend further across the loop fastener pad 511*b* before sticking the pads together, while if a user's hand is large, the hook fastener 511*a* pad will tend to extend to a lesser extent across the loop fastener pad 511*b* before sticking the pads together. Once the strap 509 is securely fastened to a user's hand, the bridge plate 501 will remain in an upright position on the top side of the user's hand so that the user can place a cue in any one of the notches 501*a* or holes 501*b* to support and angle the cue to hit a billiard or pool ball.

Figure 6:
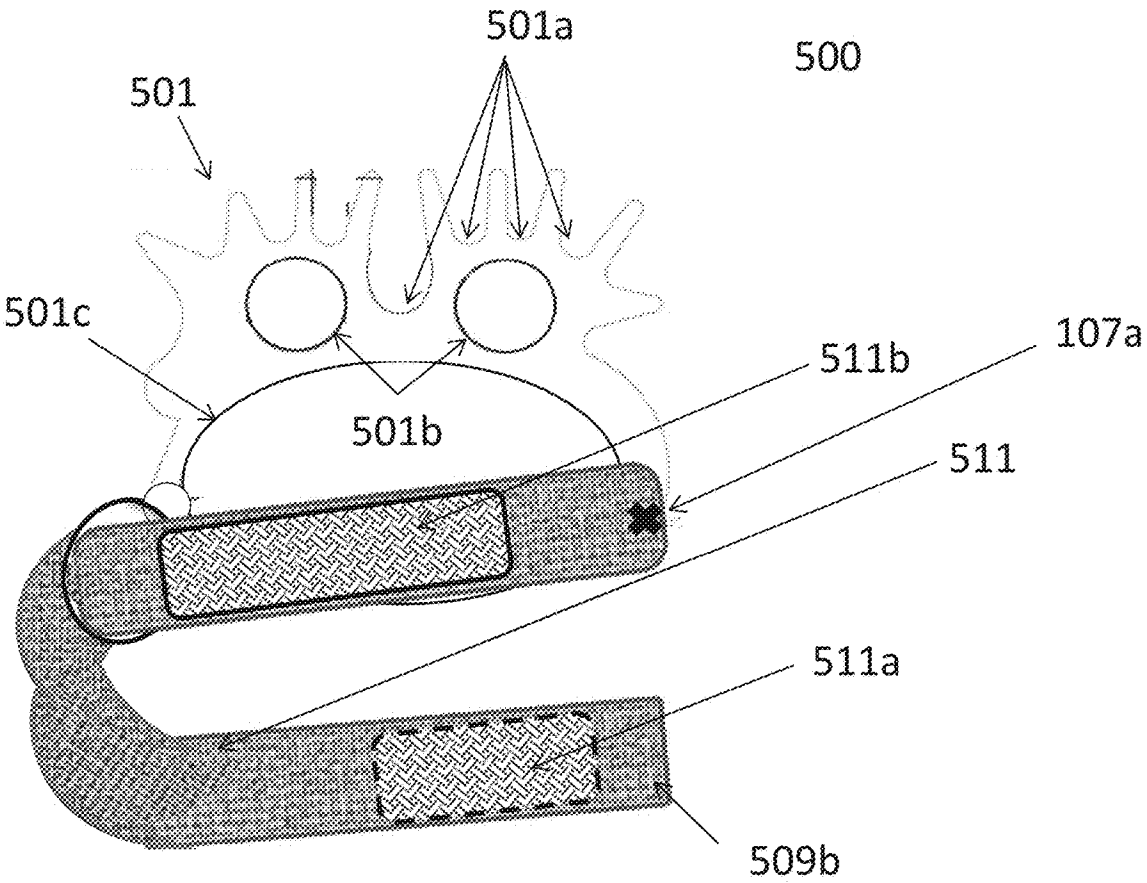
FIG. 6 illustrates the hand bridge apparatus of FIG. 5 in a fully assembled configuration.

FIG. 6 illustrates the hand bridge apparatus 500 in operation. As illustrated, once the user places the bottom curved portion 501*c* of the bridge plate 501 on top of the user's hand, the user will feed the end 509*b* of the strap 509 through the loop 505 and then fold the strap 509 over and pull the end 509*b* of the strap 509 until the hook fastener 511*a* pad aligns with the loop fastener pad 511*b*, at which the user can extend the hook fastener pad 509*a* over the loop fastener pad 511*b* until a point where the hand bridge apparatus 500 feels snug on the user's hand. Then the user can stick the hook fastener pad 511*a* to the loop fastener pad 511*b*, thus fully supporting the bridge plate 501 to stand upright to support and help angle a cue. Also illustrated is the other end 509*a* of the strap 509 in its riveted position to the eyelet 503*b* (not illustrated) with a rivet 107*a*.

Figure 7:
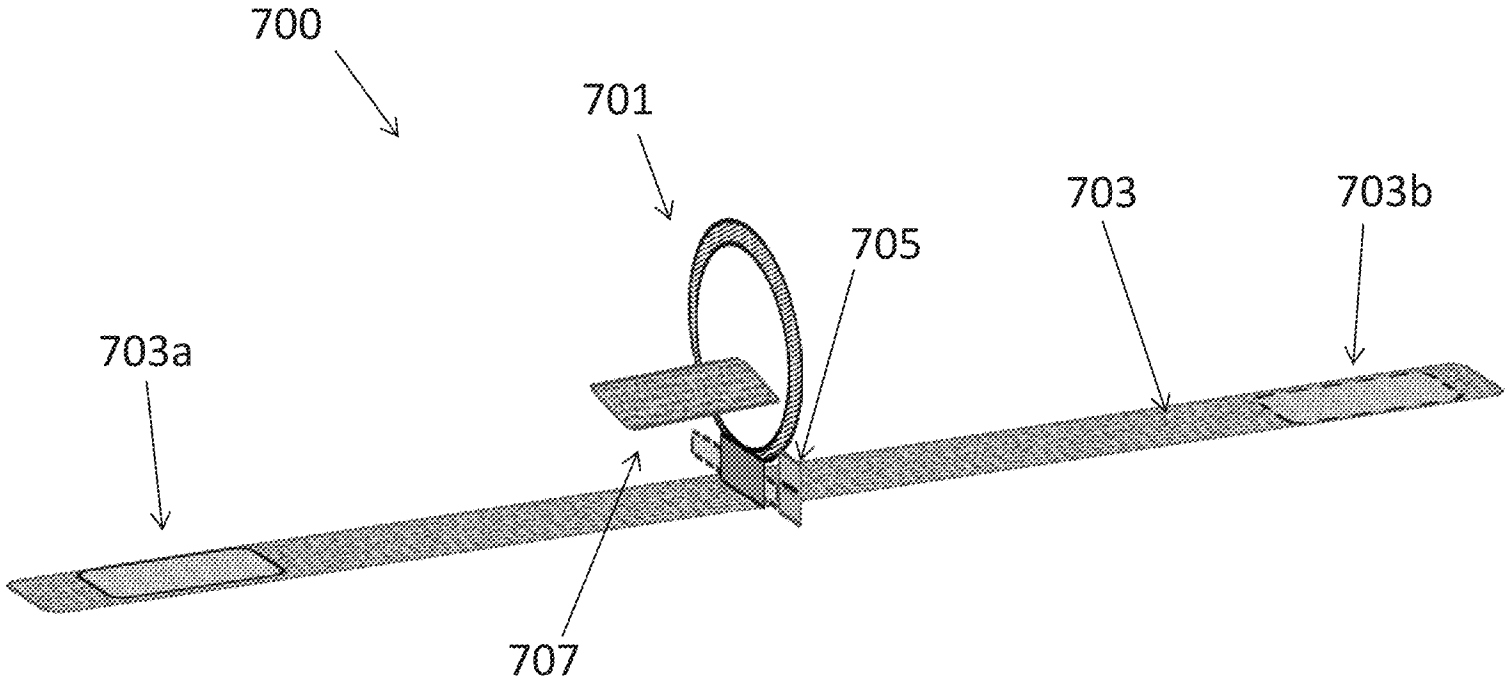
FIG. 7 illustrates a plan view of a cueing ring apparatus according to another example embodiment of the present inventive concept.

FIG. 7 illustrates a cue stick sling apparatus 700 according to another example embodiment of the present inventive concept. This cue stick sling apparatus 700 includes an adjustable cue ring 701 that includes tracks 701*a* (see FIG. 9) in which threads of a screw 705 can tighten or loosen the cue ring 701 as the threads turn along the tracks 701*a* of the ring 701. The cue stick sling apparatus 700 also includes a strap 703 including a hook fastener 703*a* pad and a loop fastener pad 703*b* to stick to each other after the strap 703 has been wrapped around a user's hand so that the cue ring 701 sits upright above the upper side of the user's hand to insert a cue to help support the cue for shooting billiards or pool.

A pad 707 is inserted half-way through the cue ring 701 such that a first end is sewn to the strap 703 at one side of the cue ring 701 and a second end of the pad 707 is sewn to the strap 703 at another side of the cue ring 701. This pad 707 is sewn to the strap 703 tightly during manufacturing so that the cue ring 701 is securely fastened to the strap 703 such that the cue ring 701 and screw 705 assembly cannot move with respect to the strap 703.

Figure 8:
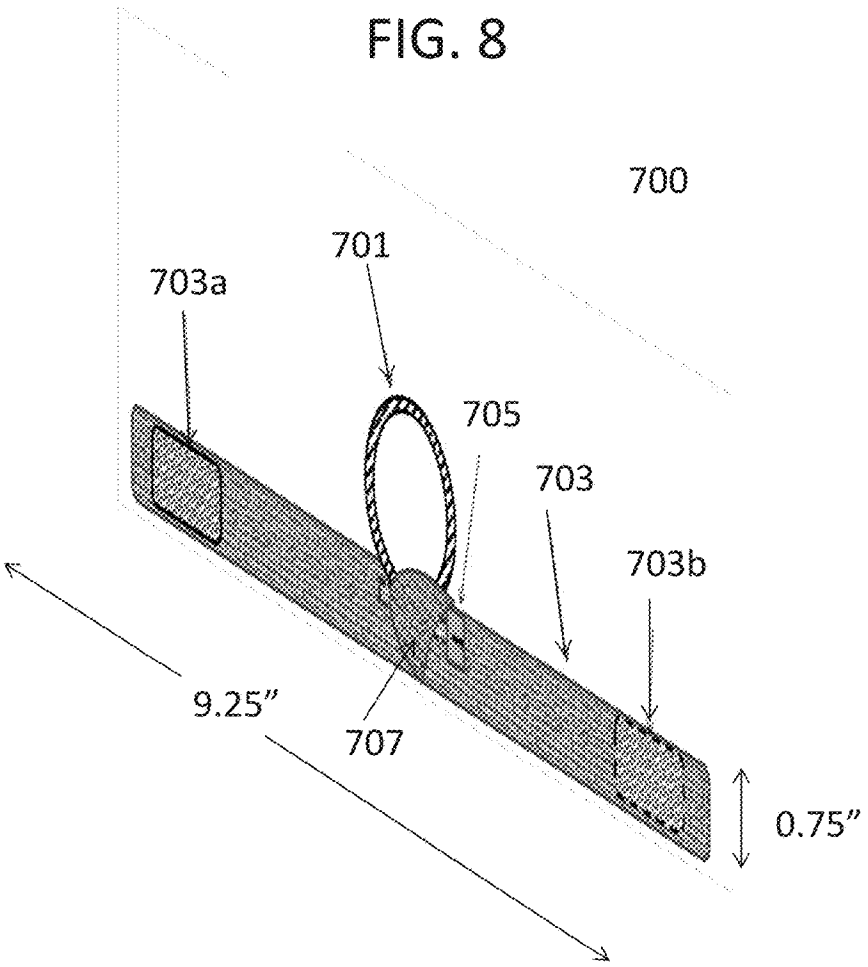
FIG. 8 illustrates a perspective view of the cueing ring apparatus according the embodiment of FIG. 7.

FIG. 8 illustrates a side view of the cue stick sling apparatus 700. The cue ring 701 and screw 705 assembly is sewn securely to the strap 703 with the pad 707. Then the user can place the strap 703 over the top of the user's hand and swing the hook fastener 703*a* pad across the user's palm and stick the hook fastener pad 703*a* to the loop fastener pad 703*b* so that the cue ring 701 sits firmly upright on the top of the user's hand. The user can then insert a pool cue into the cue ring 701 to aim the tip of the cue at a billiards ball or pool ball. As illustrated, the width of the strap 703 can be approximately 0.75 inches to provide a wide enough base to support the cue ring 701 to remain upright. The length of the strap 703 is approximately 9.25 inches to provide sufficient length to fit most user's hands. However, both the wide and length of the strap 703 can be custom designed to fit any size of a user's hand.

Figure 9:
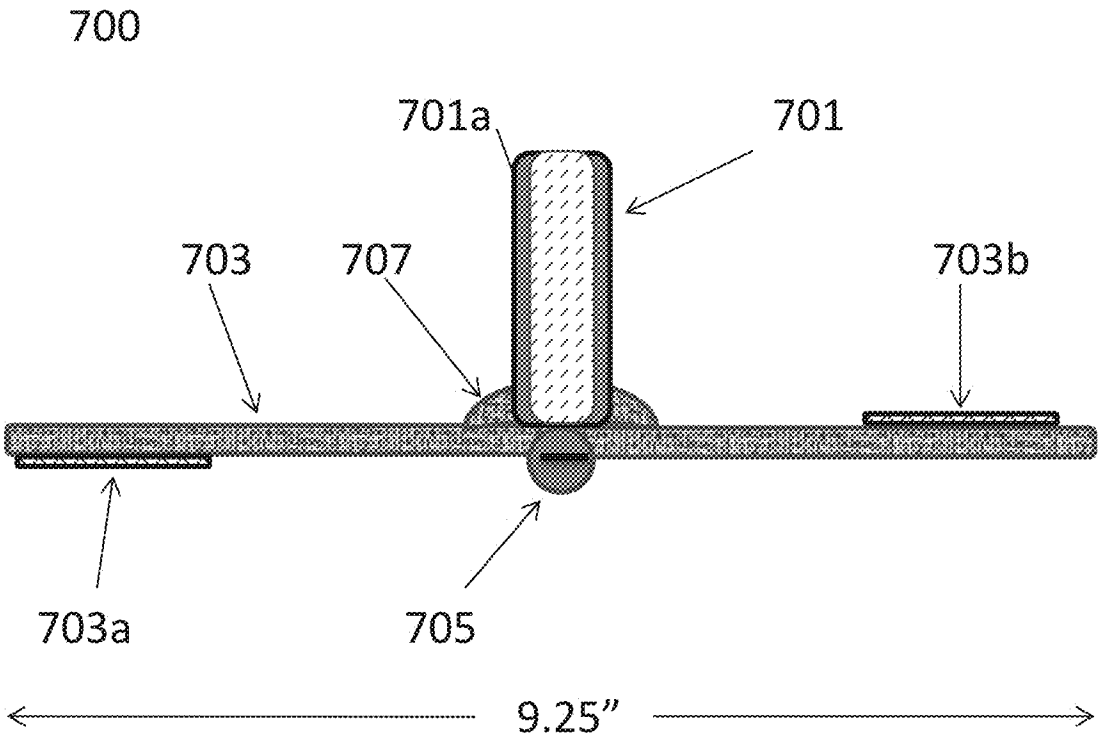
FIG. 9 illustrates a side view of the cueing ring apparatus according the embodiment of FIG. 7.

FIG. 9 illustrates a side view of the cue stick sling apparatus 700. The cue ring 701 can be tightened or loosened by turning the screw 705 so that the threads of the screw pull the tracks 701*a* or push the tracks 701*a*, thus changing a diameter of the cue ring 701 as desired.

Figure 10:
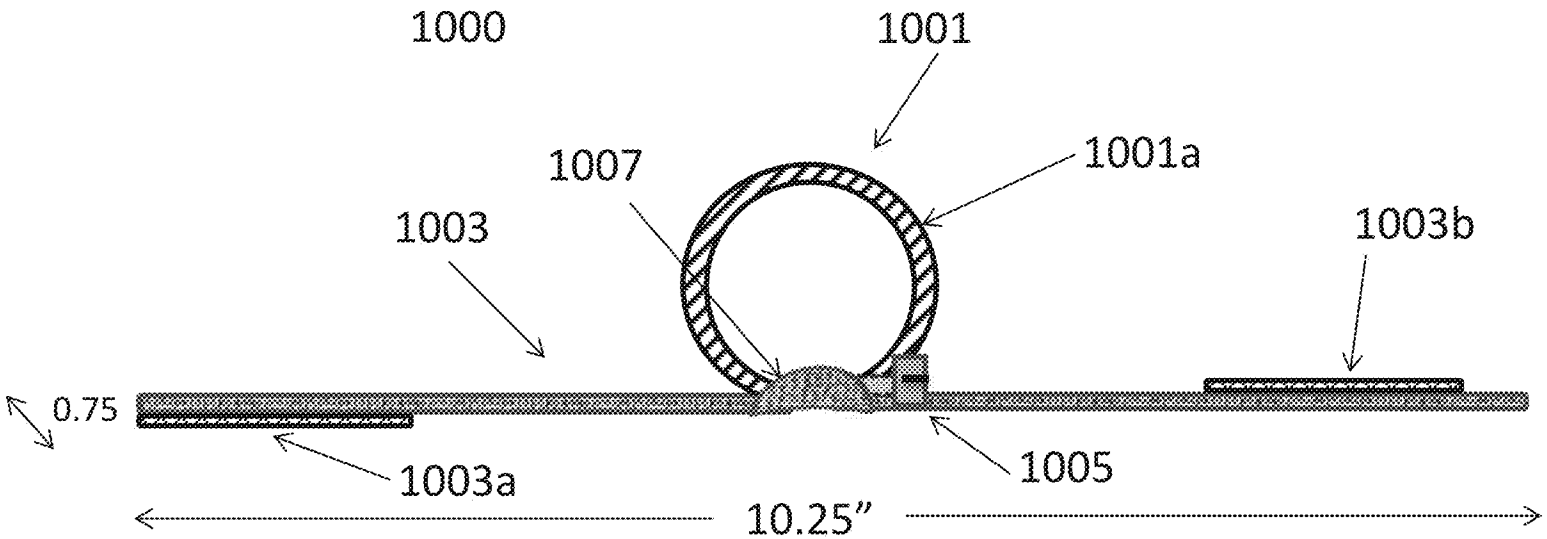
FIG. 10 illustrates a side view of an arm cue stick sling apparatus according to still another example embodiment of the present inventive concept.

FIG. 10 illustrates a full side view of an arm cue sling apparatus 1000 according to still another example embodiment of the present inventive concept. This arm cue sling apparatus 1000 has similar features as the cue stick ring apparatus 700 according to the embodiment of FIG. 7, except that a cue ring 1001 is aligned circumferentially with a length of a strap 1003, and the length of the strap 1003 is longer than the strap 703 of the cue stick ring apparatus 700. The strap 1003 can be approximately 10.25" in order to accommodate a user's forearm. More specifically, a user can wrap the strap 7003 around one's forearm and then connect a hook fastener pad 1003*a* to a loop fastener pad 1003*b* so the cue ring 1001 sits extending away from the user's forearm at any position most comfortable for the user to hold a cue while pointing the cue toward a billiard ball or a pool ball. In the configuration of the arm cue sling apparatus 1000, when the strap 1003 is strapped around a user's forearm, an axis of the cue ring 1001 is aligned with the user's forearm. Thus the user's arm will point in the same direction as the cue when the cue is inserted and secured within the cue ring 1001. Also with this arm cue sling apparatus 1000 a user can easily point his/her arm directly vertical, and then be able to carry the cue vertically while the cue is secured in the cue ring 1001 as a result of tightening the cue ring 1001 with the screw 1005.

Figure 11:
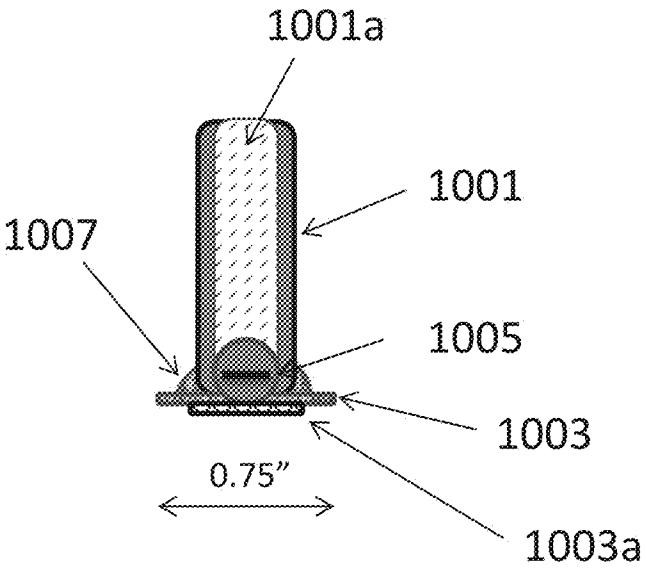
FIG. 11 illustrates a lengthwise view of the arm cue stick sling apparatus of FIG. 10.

FIG. 11 illustrates a lengthwise view of the arm cue sling apparatus 1000 with the strap 1003 extending perpendicular into the page and the circumference of the cue ring also extending perpendicular into the page. The hook fastener pad 1003*b* is illustrated in this position, which is at a far end of the strap 1003.

Here the user will most likely also use the fully assembled arm bridge apparatus 100 according to the embodiment of FIG. 1 or the fully assembled hand bridge apparatus 500 according to the embodiment of FIG. 6.

For example, if the user has no hands, the user can fasten the arm cue sling apparatus 1000 to one arm and fasten the arm bridge apparatus 100 to the other arm. Then the user can operate the cue with the arm cue sling apparatus 1000 while resting and aiming the end of cue closest to the tip within either the notches 101*c* or holes 101*b* in the bridge 101. Alternatively, if the user has one hand only, the user can fasten the arm cue sling apparatus 1000 to his/her arm having no hand and then fasten the hand bridge apparatus 500 to the one hand on the other arm. Thus the user can operate the cue with the arm cue sling apparatus 1000 while resting and aiming the end of cue closest to the tip in one of the notches 501*a* or holes 501*b* of the hand bridge apparatus 500. The cue is securely fastened into the cue ring 1001 by tightening the cue ring 1001 with the screw 1005 once the cue is in the desired position within the cue ring 1001. Thus the cue cannot move with respect to the cue ring 1001.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. An arm bridge apparatus, comprising:

a bridge plate including:

at least one notch at a top side, at least one cue hole therein to receive a cue stick, a curved bottom side, and at least two holes in a middle portion thereof adjacent to a center of the curved bottom side;

an arm support including:

a first portion extending lengthwise having at least two slits aligned with and adjacent to a first side of the first portion, and a second portion extending at a predetermined angle away from one end of the first portion, the second portion being shorter than the first portion and connected to the bridge plate at the at least two holes therein; and at least two straps connected at a first end to a second side of first portion of the arm support, each strap extending across a bottom of the arm support and extending into a respective one of the slits along the first side of the first portion of the arm support, the at least two straps including a fastener to fasten the straps around a user's forearm.

2. The hand bridge according to claim 1, wherein the bridge plate includes a plurality of notches on each side of the top side thereof.

3. The hand bridge according to claim 1, wherein the bridge plate includes a cue hold equally disposed at opposite sides thereof.

4. The hand bridge according to claim 1, wherein the at least two straps are formed of nylon or leather.

5. The hand bridge according to claim 1, wherein the bridge plate and the second portion of the arm support are connected by rivets.

6. The hand bridge according to claim 1, wherein the fasteners are a pair of hook and loop fastener pads.

7. The hand bridge according to claim 6, wherein the first portion of the arm support further comprises a loop fastened to the second side thereof adjacent to the first end of each strap, each loop having a length to receive a second end of each respective strap after the strap is wrapped around the person's forearm such that the hook fastener pad extends through the respective loop and folds over to attach to the loop fastener pad.

8. The hand bridge according to claim 6, wherein the hook fastener pad and the loop fastener pad are positioned on opposite sides of the respective strap such that when the strap is wrapped around the person's forearm, the hook fastener pad attaches to the loop fastener pad.

9. The hand bridge according to claim 1, wherein the bridge plate is formed of wood.

10. A hand bridge apparatus, comprising: a bridge plate including: at least one notch at a top side, at least one cue hole therein to receive a cue stick, a curved bottom side having ends and a eyelet extending through each end of the curved bottom side, and at least two holes in a middle portion thereof adjacent to a center of the curved bottom side; a strap with a first end connected to a first one of the eyelets, including: a first connecting member, and at least one second connecting member positioned such that the first connecting member can fold over and attach to the at least one second connecting member; and a loop extending through a second eyelet to receive a second end of the strap and the first connecting member such that the first connecting member can fold over and connect to the at least one second connecting member.

11. The hand bridge according to claim 10, wherein the first connecting member is a hook fastener pad and the at least one second connecting member is a loop fastener pad.

12. The hand bridge according to claim 10, wherein the first connecting member is a slit through the strap and the at least one second connecting member is at least one button.

13. The hand bridge according to claim 10, wherein the first end of the strap is connected to the first eyelet via a rivet.

14. A cue ring apparatus to support a cue therein, comprising; a strap including a hook fastener pad attached at a first end thereof and on a first side and a loop fastener pad attached at a second end thereof on a second side; an adjustable cue ring connected at a center of the strap such that the cue ring extends perpendicular to the strap, wherein the adjustable cue ring includes tracks extending circumferentially around the ring and a screw connected at a side thereof such that threads of the screw engage with the tracks to adjust a diameter of the ring when the screw is rotated.

15. The cue ring apparatus according to claim 14, wherein the cue ring is connected to the strap by sewing the cue ring to the strap.

16. An arm cue sling apparatus, comprising: a strap including a hook fastener pad attached at a first end thereof and on a first side thereof, and a loop fastener pad attached at a second end thereof and on a second side thereof; an adjustable cue ring connected at a center of the strap such that the cue ring extends directly parallel with the strap, wherein the adjustable cue ring includes tracks extending circumferentially around the ring and a screw connected at a side thereof such that threads of the screw engage with the tracks to adjust a diameter of the cue ring when the screw is rotated.

17. The cue ring apparatus according to claim 16, wherein the cue ring is connected to the strap by sewing the cue ring to the strap.

18. The cue ring apparatus according to claim 16, wherein the strap is approximately 10.25 inches in length to extend around and fasten to a person's arm.

* * * * *